US009388002B2

(12) United States Patent
Kojima et al.

(10) Patent No.: US 9,388,002 B2
(45) Date of Patent: Jul. 12, 2016

(54) MEDIUM CONVEYANCE DEVICE

(71) Applicant: Oki Electric Industry Co., Ltd., Tokyo (JP)

(72) Inventors: Ryousuke Kojima, Tokyo (JP); Yoshiyuki Tosaka, Tokyo (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/440,871

(22) PCT Filed: Oct. 7, 2013

(86) PCT No.: PCT/JP2013/077266
§ 371 (c)(1),
(2) Date: May 5, 2015

(87) PCT Pub. No.: WO2014/077052
PCT Pub. Date: May 22, 2014

(65) Prior Publication Data

US 2015/0274459 A1 Oct. 1, 2015

(30) Foreign Application Priority Data

Nov. 13, 2012 (JP) ..... 2012-249637

(51) Int. Cl.
*B65H 5/22* (2006.01)
*B65H 5/06* (2006.01)
*B65H 5/26* (2006.01)

(52) U.S. Cl.
CPC ..... *B65H 5/062* (2013.01); *B65H 5/26* (2013.01); *B65H 2402/545* (2013.01); *B65H 2402/546* (2013.01); *B65H 2404/152* (2013.01); *B65H 2404/1541* (2013.01); *B65H 2701/1912* (2013.01)

(58) Field of Classification Search
CPC .. B65H 5/062; B65H 5/26; B65H 2404/1451; B65H 2404/15212; B65H 2701/1912; B65H 2402/545; B65H 2402/546
See application file for complete search history.

(56) References Cited

U.S. PATENT DOCUMENTS 5,982,477 A * 11/1999 Trafton ..... H04N 1/121 355/75
6,722,649 B2 * 4/2004 Yui ..... B65H 5/06 271/184

(Continued)

FOREIGN PATENT DOCUMENTS

JP S60-40519 Y2 12/1985
JP S65-9936 U 1/1989
JP H05-69981 A 3/1993

(Continued)

*Primary Examiner* — Howard Sanders
(74) *Attorney, Agent, or Firm* — Rabin & Berdo, P.C.

(57) ABSTRACT

The present invention provides a medium conveyance device whose reliability is enhanced. Namely, a roller conveyance section uses support parts to couple together an upper side shaft, which receives a first reaction force produced in accordance with a first contact-pressure force that urges first driven rollers toward first drive rollers, and a lower side shaft, which receives a second reaction force produced in accordance with a second contact-pressure force that urges second driven rollers toward second drive rollers. Because of this, the medium conveyance device of the present invention may cancel out the two reaction forces that cause an upper side guide and a lower side guide to bend in two bank note conveyance paths adjacent to one another.

7 Claims, 12 Drawing Sheets

(56) References Cited

U.S. PATENT DOCUMENTS

2004/0256794 A1* 12/2004 Barthold ..... B65H 5/062
271/272
2010/0072246 A1* 3/2010 Seo ..... B65H 23/02
226/194
2015/0298929 A1* 10/2015 Hiratsuka ..... B65H 29/125
194/206

FOREIGN PATENT DOCUMENTS

JP H08-11375 A 1/1996
JP 2011-002921 A 1/2011

* cited by examiner

MEDIUM CONVEYANCE DEVICE

TECHNICAL FIELD

The present invention relates to a medium conveyance device and is, for example, applicable to a bank note processing device into which a medium such as cash is put and which performs desired transactions.

BACKGROUND ART

Conventionally, bank note processing devices used in financial institutions have been configured to allow customers to deposit cash such as bank notes and coins there into, and to dispense cash to customers in accordance with the transactions conducted with the customers.

As such a bank note processing device, there is a bank note processing device having: a bank note deposit and withdrawal opening that accepts bank notes from and dispenses bank notes to a customer; a discriminating section that discriminates the denominations and authenticity of bank notes that have been put in; a temporary holding section that temporarily holds bank notes that have been put in; and denomination cassettes that store bank notes by denomination.

This bank note processing device conveys bank notes by joining together, with a conveyance path disposed inside a casing, the various sections including the bank note deposit and withdrawal opening, the discriminating section, the temporary holding section, and the denomination cassettes (e.g., see Japanese Patent Application Laid-Open No. 2011-2921 (FIG. 1)).

Among such bank note processing devices, there is a bank note processing device that uses a roller conveyance section 620 that conveys bank notes by means of the mechanism shown in FIG. 11 and FIG. 12.

The roller conveyance section 620 has drive rollers 26 disposed such that they may freely rotate, and driven rollers 30 that press bank notes BL against the drive rollers 26 in a direction perpendicular to a surface direction which is a direction in which the surfaces of the bank notes BL extend.

Between the drive rollers 26 and the driven rollers 30, there is disposed a plate-like guide 646 that forms a bank note conveyance path 48 on which the bank notes travel, and the right and left end portions of the guide 646 are fixed to a frame 19. A guide top plate 646U guides the bank notes BL from the upper side, and a guide bottom plate 646L guides the bank notes BL from the lower side.

Coiled portions 40, which are front and rear direction center sections of single metal rods of springs 38 that are torsion bar springs, are coiled around a cylindrically shaped shaft 36 fixed to plate-like ribs 35 disposed standing upright from the guide top plate 646U.

Front arm portions 41, which are parts of the torsion bar springs, extend in the frontward direction from the coiled portions 40, and rear arm portions 42 extend in the rearward direction from the coiled portions 40.

The springs 38 contact the upper end of a driven roller shaft 32F and the upper end of a driven roller shaft 32R in a state in which the front end portions of the front arm portions 41 and the rear end portions of the rear arm portions 42 are positioned further in the upward direction than in their natural state.

For this reason, when a contact-pressure force FCD heading toward the drive rollers 26 is applied from the springs 38 to the driven rollers 30, the outer peripheral surfaces of the driven rollers 30 are pressed against the drive rollers 26.

In the roller conveyance section 620, an upward reaction force FRU corresponding to the downward contact-pressure force FCD acts on the shaft 36 via the springs 38.

SUMMARY OF INVENTION

Technical Problem

In the roller conveyance section 620, in order to reduce the number of members and save space, the shaft 36 is fixed to the guide top plate 646U via the ribs 35 rather than being fixed to the frame 19. For this reason, the reaction force FRU is transmitted to the guide top plate 646U, and so the center section of the guide top plate 646U ends up bending in such a way as to rise upward using its right and left end portions as supports.

When the guide 646 becomes deformed in this way, the bank note conveyance path 48 ends up becoming deformed, so conveyance troubles occur in relation to the bank notes BL and reliability may be reduced.

The present invention provides a medium conveyance device whose reliability is enhanced.

Solution to Problem

A first aspect of the present invention is a medium conveyance device including: a first conveyance path that conveys a medium; first drive rollers that contact the medium and that cause the medium to move by rotation; first driven rollers, disposed opposing the first drive rollers across the first conveyance path, that contact the medium and rotate in accordance with the rotation of the first drive rollers; first contact-pressure portions that apply a first contact-pressure force that urges the first driven rollers toward the first drive rollers; a second conveyance path that is adjacent to the first conveyance path and conveys a medium; second drive rollers that contact the medium and that cause the medium to move by rotation; second driven rollers, disposed opposing the first driven rollers and also opposing the second drive rollers across the second conveyance path, that contact the medium and rotate in accordance with the rotation of the second drive rollers; second contact-pressure portions that apply a second contact-pressure force that urges the second driven rollers toward the second drive rollers; and support portions that couple a first reaction force receiving portion that receives a first reaction force produced toward the second conveyance path in accordance with the first contact-pressure force and a second reaction force receiving portion that receives a second reaction force produced toward the first conveyance path in accordance with the second contact-pressure force.

Advantageous Effects of Invention

According to the first aspect of the present invention, the present invention may cancel out the first reaction force and the second reaction force that are produced in accordance with the first contact-pressure force and the second contact-pressure force that are applied to the first driven rollers and the second driven rollers in order to convey the medium in the first conveyance path and the second conveyance path that are adjacent to one another, and which first reaction force and second reaction force cause the first conveyance path and the second conveyance path to become deformed. In this way, the present invention may provide a medium conveyance device whose reliability can be enhanced.

DESCRIPTION OF EMBODIMENTS

Modes for carrying out the invention (hereinafter called exemplary embodiments) will be described in detail below using the drawings.

1. First Exemplary Embodiment

1-1. External Configuration of Bank Note Processing Device

Figure 1:
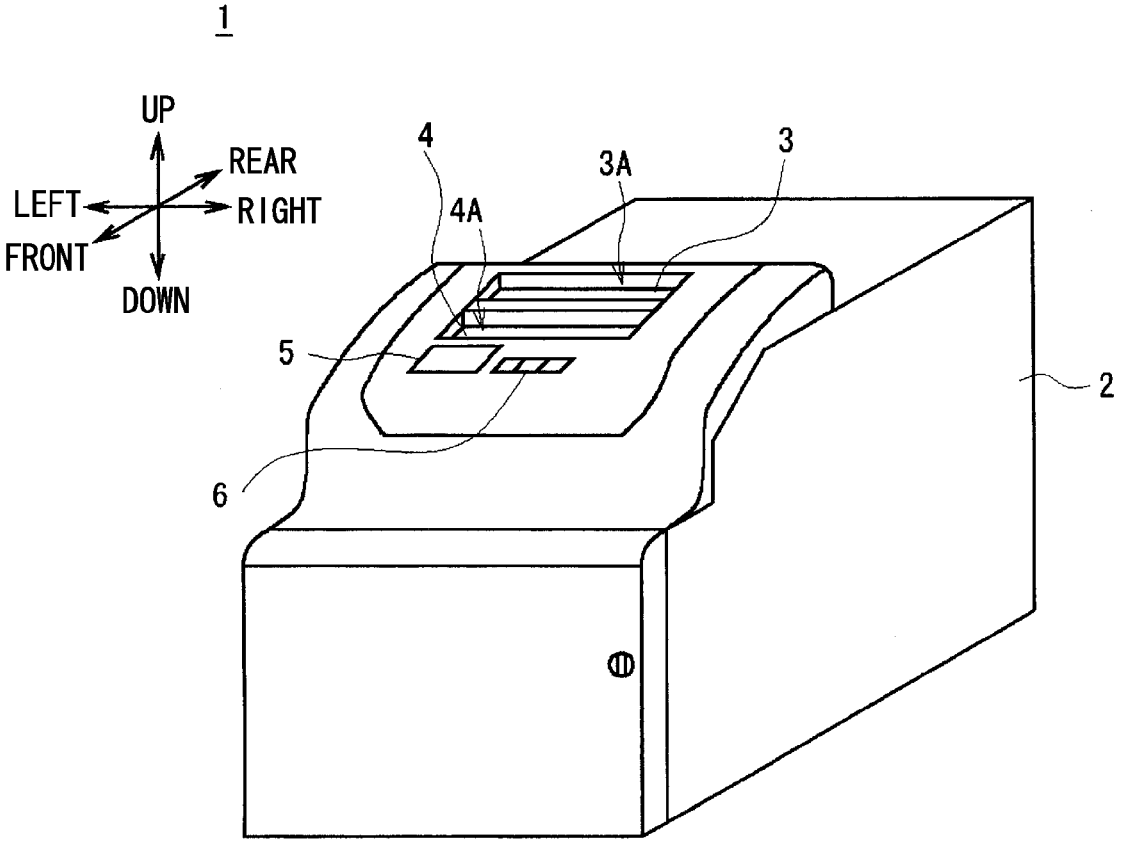
FIG. 1 is a perspective view showing the external configuration of a bank note processing device.

As shown in FIG. 1, a bank note processing device 1 is a staff member-operated terminal operated by a staff member (e.g., a teller) of a financial institution and is configured to perform bank note deposit and withdrawal processes on the basis of the operations by the staff member.

The bank note processing device 1 has a box-like casing 2 in the upper end portion of which are disposed an insertion opening 3A of a deposit section 3, a dispensing opening 4A of a withdrawal section 4, a display section 5, and an operation section 6.

The deposit section 3 is configured such that, when bank notes for deposit are put into the deposit section 3 from the insertion opening 3A by the staff member, the deposit section 3 separates the bank notes one at a time and takes them into the bank note processing device 1.

The withdrawal section 4 is configured to stack bank notes for withdrawal and allow them to be taken out by the staff member from the dispensing opening 4A. Furthermore, a shutter (not shown in the drawings) that opens and closes the dispensing opening 4A is disposed in the withdrawal section 4, and the shutter is configured to open when dispensing bank notes.

The display section 5 is configured by a liquid crystal display, for example, and displays menu screens and screens showing results of various types of processes. The operation section 6 is configured by buttons, for example, and receives operations with respect to the bank note processing device 1.

It will be noted that although the display section 5 and the operation section 6 are separately disposed in the bank note processing device 1, the display section 5 and the operation section 6 may also be integrally disposed utilizing a liquid crystal display having a touch panel, for example.

Moreover, although it is not shown in the drawings, the bank note processing device 1 is configured in such a way that it can communicate with other terminals and a host computer of the financial institution via a network so that it can transmit various types of information to and receive various types of information from the other terminals and the host computer and can be operated from the other terminals.

1-2. Internal Configuration of Bank Note Processing Device

Figure 2:
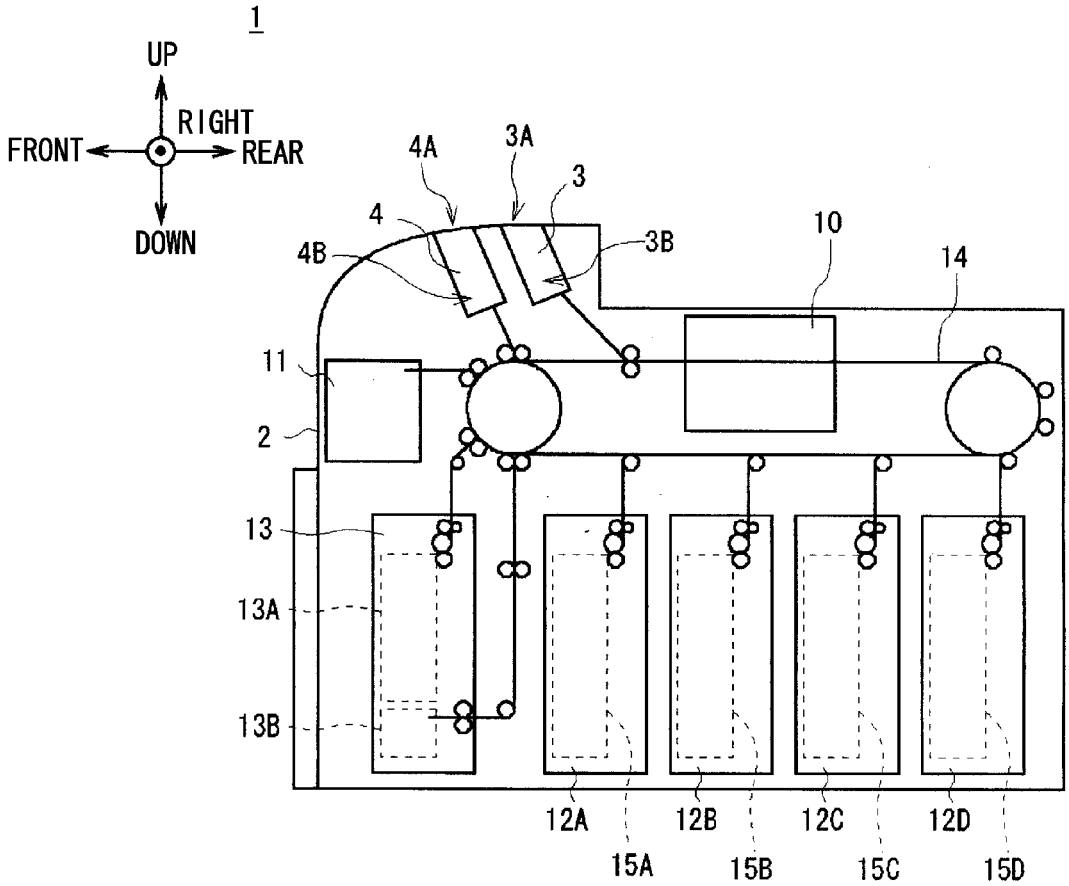
FIG. 2 is a right side view showing the internal configuration of the bank note processing device.

As shown in FIG. 2, in addition to the deposit section 3 and the withdrawal section 4 described above, a discriminating section 10, a temporary holding section 11, bank note cassettes 12A to 12D, a reject container-attached bank note cassette 13, and a conveyance path 14 are disposed inside the casing 2 of the bank note processing device 1.

The deposit section 3 and the withdrawal section 4 are disposed side by side in the front and rear direction in the upper portion of the inside of the casing 2 in such a way that the deposit section 3 is positioned on the rear side and the withdrawal section 4 is positioned on the front side. Furthermore, the temporary holding section 11 is disposed in front of and obliquely below the withdrawal section 4, and on the rear side of the temporary holding section 11 the discriminating section 10 is disposed in back of and obliquely below the deposit section 3.

Moreover, the bank note cassettes 12A to 12D and the reject container-attached bank note cassette 13 are disposed side by side in the front and rear direction in the lower portion of the inside of the casing 2.

In the bank note processing device 1, the reject container-attached bank note cassette 13 is disposed on the front most side, and behind that the bank note cassettes 12A to 12D are disposed side by side in the order of the bank note cassettes 12A, 12B, 12C, and 12D.

Moreover, the conveyance path 14 that joins together the various sections including the deposit section 3, the withdrawal section 4, the discriminating section 10, the temporary holding section 11, and the bank note cassettes 12A to 12D is disposed inside the casing 2.

The conveyance path 14 is configured by plural belt conveyance sections and later-described roller conveyance sections. In the belt conveyance sections, two sets of tapes that are entrained about pairs of rollers disposed opposing one another and revolve between the rollers are disposed, and the bank notes are conveyed as a result of being sandwiched from both sides between and held by the two sets of tapes.

The roller conveyance sections are mainly disposed between belt conveyance sections that are adjacent to one another, and the bank notes are conveyed as a result of being sandwiched between and held by later-described driven rollers and drive rollers.

The deposit section 3 has a box-like storage section 3B whose upper surface is open. Part of the opening in the storage section 3B is the aforementioned insertion opening 3A. The deposit section 3 separates one at a time and takes into the bank note processing device 1 bank notes for deposit that have been put into the storage section 3B from the insertion opening 3A during a deposit transaction.

The withdrawal section 4 has a box-like stacking portion 4B whose upper surface is open. The opening in the stacking portion 4B is the aforementioned dispensing opening 4A. The withdrawal section 4 stacks in the stacking portion 4B bank notes for withdrawal conveyed thereto from the bank note cassettes 12A to 12D during a withdrawal transaction.

Furthermore, a shutter (not shown in the drawings) that opens and closes the dispensing opening 4A is disposed in the withdrawal section 4. The shutter is configured to open after the bank notes for withdrawal have been stacked in the stacking portion 4B. When the shutter opens, the staff member can take out from the dispensing opening 4A the bank notes for withdrawal stacked in the stacking portion 4B.

The deposit section 3 and the withdrawal section 4 are fixed in a forwardly slanted state in such a way that their upper end portions are positioned in front of their lower end portions. It will be noted that the deposit section 3 and the withdrawal section 4 are not limited to being fixed types like this and may also, for example, be movable types whose inclination in the front and rear direction can be adjusted.

The discriminating section 10 discriminates the denominations, authenticity, fitness, and traveling state of the bank notes conveyed one at a time thereto via the conveyance path 14. The discriminating section 10 determines, on the basis of the discrimination results, whether each bank note is a normal bank note that can be handled or a reject bank note that cannot be handled.

The temporary holding section 11 temporarily stacks bank notes that have been taken in from the deposit section 3 and determined to be normal bank notes by the discriminating section 10. After the completion of the transaction, the bank notes that have been stacked in the temporary holding section 11 are fed out from the temporary holding section 11 and conveyed to the discriminating section 10, where they have their denominations identified by the discriminating section 10, and are thereafter conveyed to and stored in the bank note cassettes 12A to 12D.

The bank note cassettes 12A to 12D have vertically long bank note storage containers 15A to 15D capable of storing the bank notes by denomination and stack, on top of one another in the up and down direction inside the bank note storage containers 15A to 15D, the bank notes conveyed thereto via the conveyance path 14.

Furthermore, the bank note cassettes 12A to 12D not only store the bank notes but can also feed out one at a time to the conveyance path 14 the bank notes stacked inside the bank note storage containers 15A to 15D. Moreover, the bank note cassettes 12A to 12D are detachable types that are individually detachable from the bank note processing device 1.

The reject container-attached bank note cassette 13 has a bank note storage container 13A on its upper side and a reject container 13B on its lower side. The reject container-attached bank note cassette 13 is also a detachable type detachable from the bank note processing device 1.

In the reject container-attached bank note cassette 13, for example, when collecting bank notes, bank notes that have been fed out from the bank note cassettes 12A to 12D are stored in the bank note storage container 13A. Thereafter, the staff member collects the bank notes by removing the reject container-attached bank note cassette 13 from the bank note processing device 1.

Furthermore, when restocking the bank note processing device 1 with bank notes, the staff member sets in the bank note processing device 1 the reject container-attached bank note cassette 13 whose bank note storage container 13A has been restocked with bank notes. Thereafter, the bank notes for restocking the bank note processing device 1 that are stored in the bank note storage container 13A are fed out from the reject container-attached bank note cassette 13 and conveyed to the bank note cassettes 12A to 12D via the discriminating section 10 to thereby restock the bank note cassettes 12A to 12D. In this way, the bank note processing device 1 is restocked with bank notes.

In this way, the bank note storage container 13A of the reject container-attached bank note cassette 13 is configured in such a way that it can be utilized for several purposes.

Furthermore, the reject container 13B of the reject container-attached bank note cassette stacks bank notes determined to be reject bank notes by the discriminating section 10.

Furthermore, a control section (not shown in the drawings) that controls the entire bank note processing device 1 is disposed in a predetermined place inside the casing 2.

The bank note processing device 1 having the configuration described above performs a bank note deposit process and withdrawal process, with the control section controlling the various sections on the basis of, for example, the bank note discrimination results reached by the discrimination section 10.

That is, at the time of a deposit transaction, when a transaction type (in this case, a deposit) is input via the operation section 6 by the staff member and bank notes are put into the deposit section 3 from the insertion opening 3A, the bank note processing device 1 conveys the input bank notes one at a time to the discriminating section 10.

Here, the bank note processing device 1 conveys to and temporarily stores in the temporary holding section 11 those bank notes determined to be normal bank notes by the discriminating section 10. At the same time, the bank note processing device 1 returns to the withdrawal section 4 those bank notes determined to be deposit reject bank notes unsuitable for deposit and returns those bank notes to the staff member by opening the shutter.

Thereafter, when the deposit amount is established by the staff member, the bank note processing device 1 conveys the bank notes stored in the temporary storage section 11 to the discriminating section 10, discriminates the denominations, and conveys to and retains in the bank note cassettes 12A to 12D the bank notes according to their denominations.

At the time of a withdrawal transaction, when a transaction type (in this case, a withdrawal) and a withdrawal amount are input via the operation section 6 by the staff member, the bank note processing device 1 recognizes the numbers of bank notes by denomination that are needed according to the requested amount, feeds out the bank notes one at a time from the bank note cassettes 12A to 12D according to the numbers of bank notes by denomination, and conveys the bank notes to the discriminating section 10.

Here, the bank note processing device 1 conveys to the withdrawal section 4 those bank notes determined to be normal bank notes by the discriminating section 10 and conveys to and temporarily stores in the temporary holding section 11 those bank notes determined to be withdrawal reject bank notes unsuitable for withdrawal.

Then, when bank notes corresponding to the requested amount are stacked in the withdrawal section 4, the bank note processing device 1 opens the shutter. Because of this, it becomes possible to take out the bank notes stacked inside the withdrawal section 4, and the staff member takes out the bank notes.

Thereafter, the bank note processing device 1 conveys to and retains in the reject container 13B of the reject container-attached bank note cassette 13 the withdrawal reject bank notes stored in the temporary holding section 11.

In this way, the bank note processing device 1 is configured to perform the bank note deposit process and withdrawal process.

1-3. Configuration of Roller Conveyance Section

Figure 3:
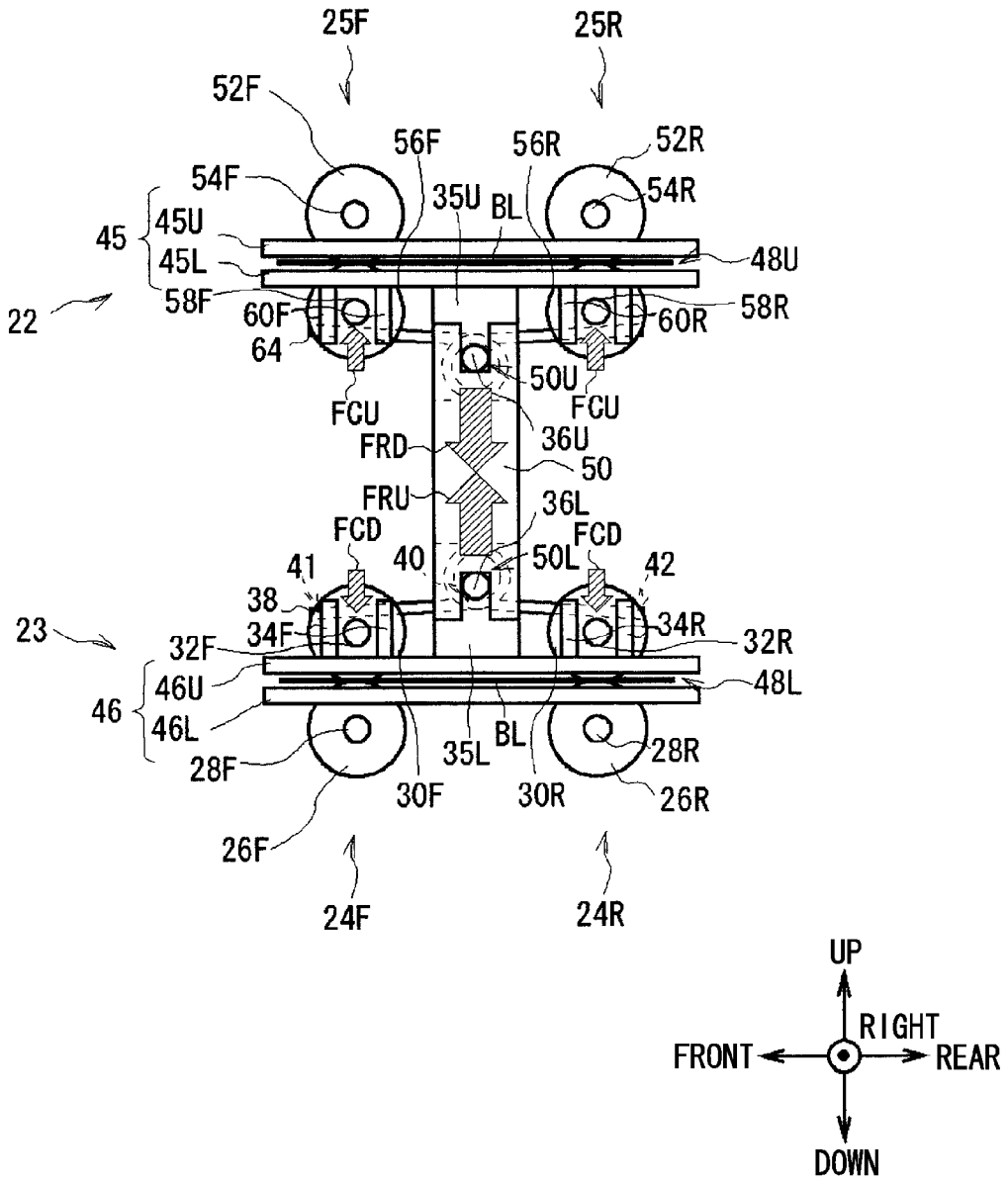
FIG. 3 is a right side view showing the configuration (1) of a roller conveyance section according to a first exemplary embodiment.
Figure 4:
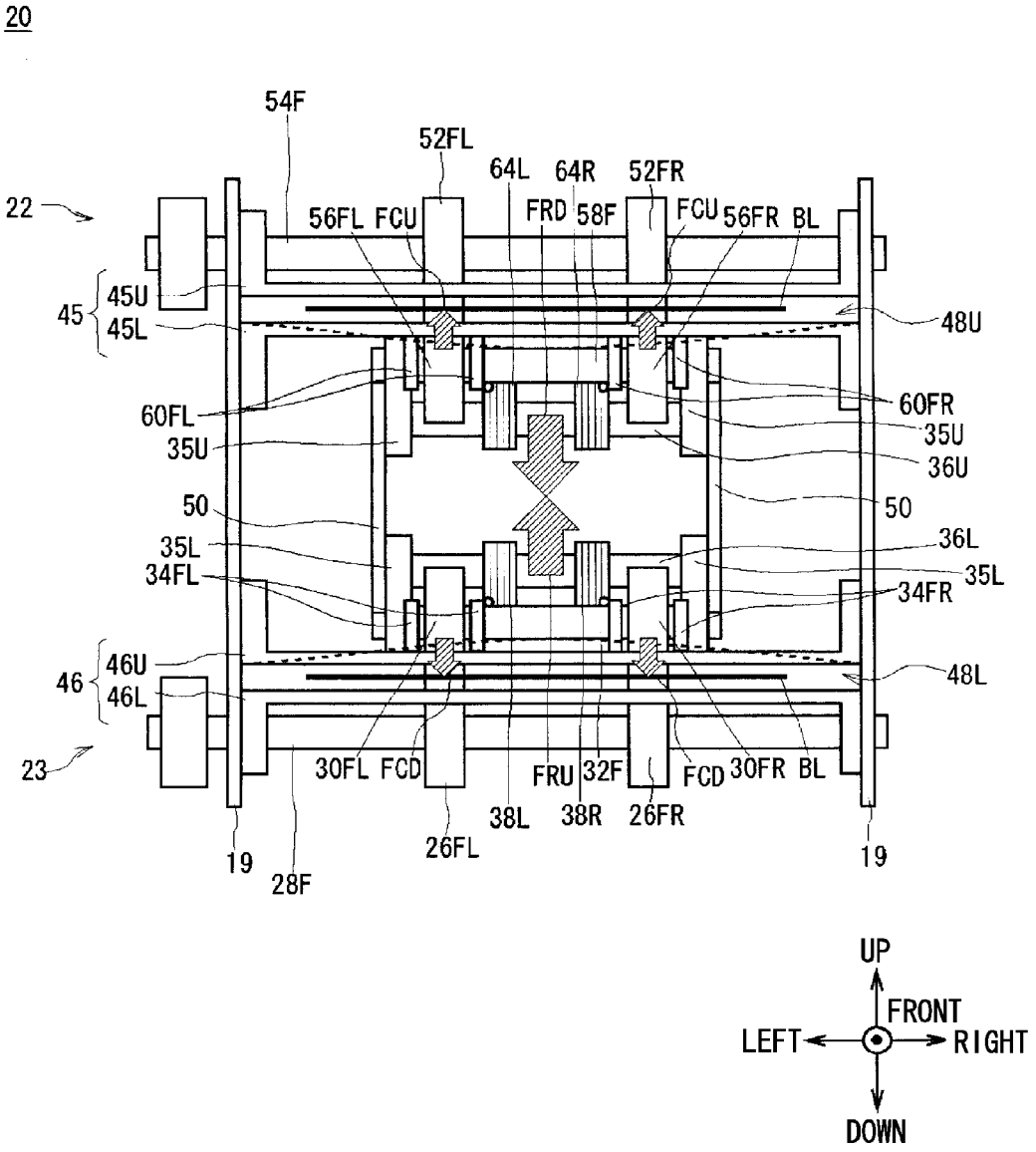
FIG. 4 is a front view showing the configuration (2) of the roller conveyance section according to the first exemplary embodiment.
Figure 11:
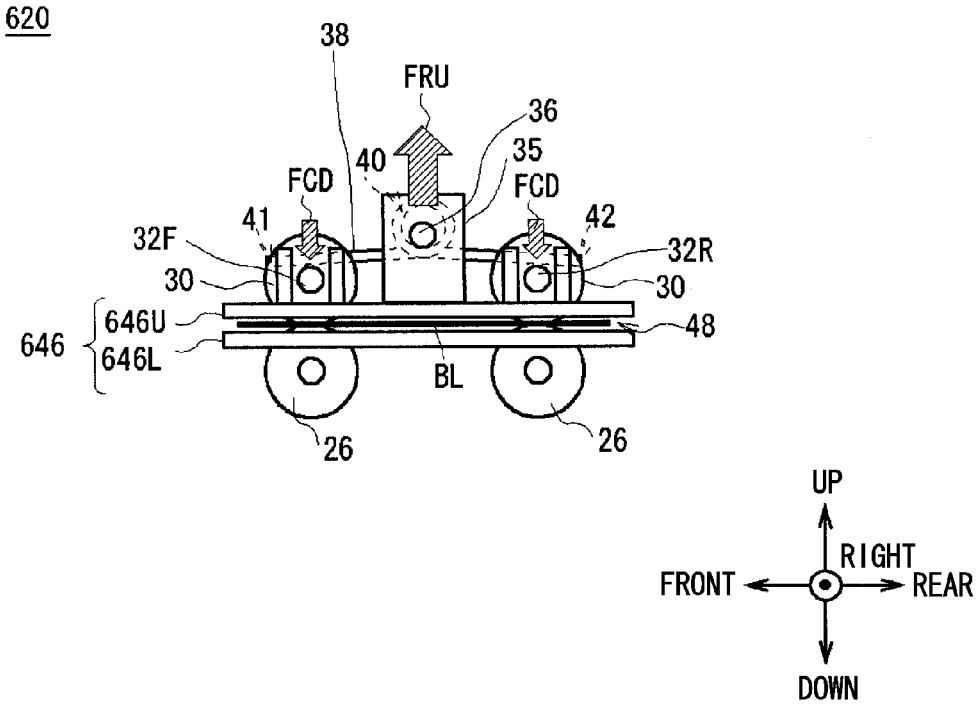
FIG.11 RELATED ART
FIG. 11 is a right side view showing the configuration (1) of a conventional roller conveyance section.
Figure 12:
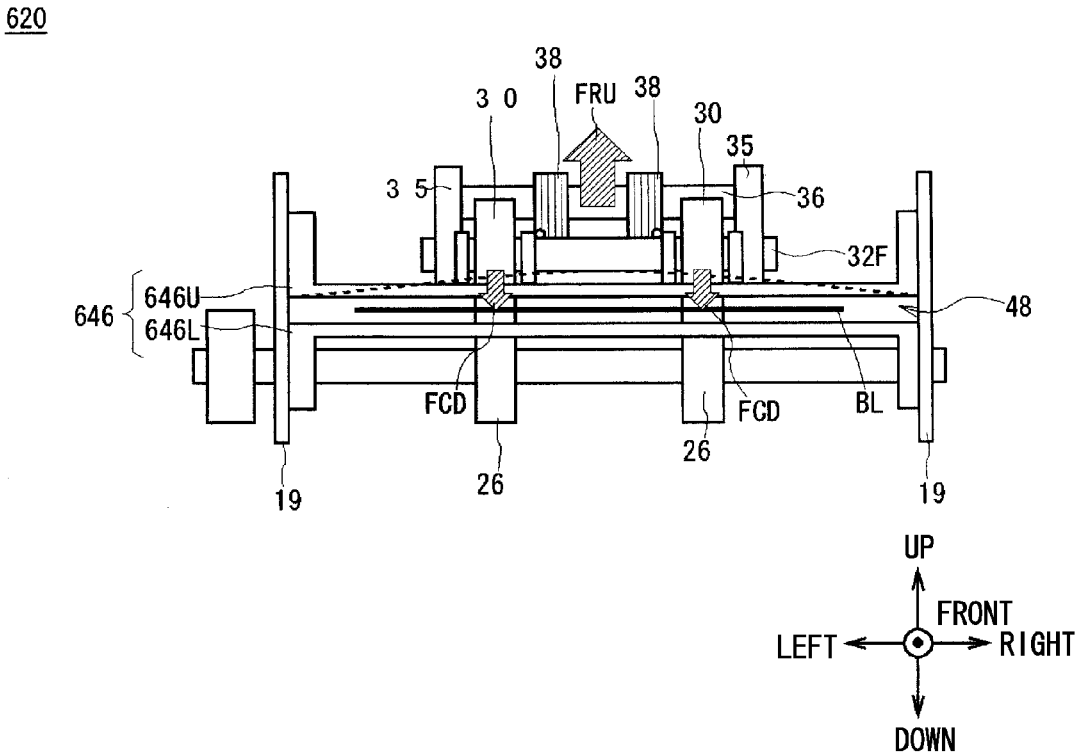
FIG.12 RELATED ART
FIG. 12 is a front view showing the configuration (2) of the conventional roller conveyance section.

FIG. 3 and FIG. 4 show a roller conveyance section 20 according to the first exemplary embodiment. The left side of FIG. 3, in which the same reference signs are assigned to sections corresponding to those in FIG. 11, is the front surface side (hereinafter also simply called the front side) of the bank note processing device 1, and the right side of FIG. 3 is the rear surface side (hereinafter also simply called the rear side) of the bank note processing device 1. It will be noted that, in FIG. 3, the frame 19 is not shown but is omitted.

The roller conveyance section 20 is configured by an upper side roller conveyance section 22 and a lower side roller conveyance section 23. The upper side roller conveyance section 22 and the lower side roller conveyance section 23 are formed in substantially the same way as one another, so below, mainly the lower side roller conveyance section 23 will be described.

In the upper and lower portions of the roller conveyance section 20, a bank note conveyance path 48U and a bank note conveyance path 48L are formed parallel to one another along the front and rear direction (horizontal direction).

In the lower side roller conveyance section 23, as shown in FIG. 3, a lower side front conveyance section 24F including drive rollers 26F, driven rollers 30F, and driven roller rails 34F and a lower side rear conveyance section 24R including drive rollers 26R, driven rollers 30R, and driven roller rails 34R are disposed so as to be bilaterally symmetrical in the front and rear direction (bilaterally symmetrical in the right and left direction on the page) about a lower side shaft 36L.

In the lower section of the lower side front conveyance section 24F, the drive rollers 26F (26FR and 26FL) are disposed such that there are two of them side by side in the right and left direction and spaced apart from one another by a distance shorter than the long-side direction length of the bank notes BL, and in such a way that they may freely rotate in the clockwise direction and the counter-clockwise direction in FIG. 3 about a cylindrically shaped drive roller shaft 28F attached along the right and left direction to the frame 19.

Above the drive rollers 26F, the driven rollers 30F (30FR and 30FL) are disposed opposing the drive rollers 26F. The driven rollers 30F are disposed such that there are two of them side by side in the right and left direction, and in such a way that they may freely rotate in the clockwise direction and the counter-clockwise direction in FIG. 3 about a cylindrically shaped driven roller shaft 32F extending in the rightward and leftward directions.

As shown in FIG. 3 and FIG. 4, on both the right and left sides and both the front and rear sides of each of the driven rollers 30FR and 30FL, the plate-like driven roller rails 34F (34FR and 34FL) are disposed on a lower side guide top plate 46U.

The width of the front and rear direction opening between the driven roller rails 34F is formed slightly larger than the front and rear direction width of the driven roller shaft 32F. Because of this, the driven roller rails 34F allow the driven roller shaft 32F to slide in the upward and downward directions.

The lower side rear conveyance section 24R is configured in the same way as the lower side front conveyance section 24F but on the rear side of the lower side shaft 36L.

The lower side shaft 36L is cylindrically shaped, is disposed on the lower side guide top plate 46U, is fixed to plate-like ribs 35L extending in the upward direction, and extends in the rightward and leftward directions.

Coiled portions 40, which are front and rear direction center sections of single metal rods of springs 38 (38R and 38L) including torsion bar springs, are coiled around the lower side shaft 36L. Front arm portions 41, which are parts of the torsion bar springs, extend in the frontward direction from the coiled portions 40, and rear arm portions 42 extend in the rearward direction.

The springs 38 contact the upper end of the driven roller shaft 32F and the upper end of a driven roller shaft 32R in a spring compressed state in which the front end portions of the front arm portions 41 and the rear end portions of the rear arm portions 42 are positioned further in the upward direction than in their natural state.

For this reason, because of the resilient force tending to return the springs 38 to their natural state, the front arm portions 41 of the springs 38 apply an urging force (contact-pressure force FCD) in the downward direction to the driven roller shaft 32F, and the rear arm portions 42 of the springs 38 apply an urging force (contact-pressure force FCD) in the downward direction to the driven roller shaft 32R.

Because of this, the right and left set of springs 38 apply the contact-pressure force FCD in the downward direction to the driven rollers 30F and 30R supported on the driven roller shafts 32F and 32R, respectively, and press the outer peripheral surfaces of the driven rollers 30F and 30R against the outer peripheral surfaces of the drive rollers 26F and 26R.

The driven rollers 30 (30F and 30R) rotate together in conjunction with the rotation of the drive rollers 26 (26F and 26R) because the driven rollers 30 are pressed against the drive rollers 26.

In this way, the lower side roller conveyance section 23 is configured in such a way the driven rollers 30F and 30R are urged by the right and left set of springs 38 and the front sections and the rear sections of the conveyed bank notes BL are sandwiched between and held by the driven rollers 30F and the drive rollers 26F disposed on the front side and the driven rollers 30R and the drive rollers 26R disposed on the rear side.

Near the lower end portions of the driven rollers 30, the lower side guide top plate 46U, which is plate-like, resin-molded, and transparent, is disposed extending along the horizontal direction frontward, rearward, rightward, and leftward.

Openings (not shown in the drawings) are drilled in the lower side guide top plate 46U in positions opposing the driven rollers 30. Because of this, the lower end portions of the driven rollers 30 project on the lower side of the lower side guide top plate 46U.

Near the upper end portions of the drive rollers 26, a plate-like lower side guide bottom plate 46L is disposed extending parallel to the lower side guide top plate 46U.

Openings (not shown in the drawings) are drilled in the lower side guide bottom plate 46L in positions opposing the drive rollers 26. Because of this, the upper end portions of the drive rollers 26 project on the upper side of the lower side guide bottom plate 46L.

In the lower side roller conveyance section 23, in the space between the lower side guide top plate 46U and the lower side guide bottom plate 46L (hereinafter these will also collectively be called a lower side guide 46), there is formed a bank note conveyance path 48L (which is part of the conveyance path 14 of FIG. 2) on which bank notes BL conveyed from a belt conveyance section or a roller conveyance section that is part of the conveyance path 14 are conveyed from the front to the rear or from the rear to the front.

That is, for example, bank notes BL that have been conveyed to the lower side roller conveyance section 23 from the rear side in FIG. 3 are conveyed toward the front side in FIG. 3 as a result of being sandwiched between and held by the rotating driven rollers 30 and drive rollers 26 while kinks and so forth are prevented by the lower side guide top plate 46U and the lower side guide bottom plate 46L.

In the roller conveyance section 20, because the lower side guide top plate 46U is configured by a transparent member, a worker can easily check, just by looking at the lower side guide 46 from above, the state of the bank notes conveyed on the bank note conveyance path 48L.

The upper side roller conveyance section 22 has the same configuration as the lower side roller conveyance section 23 and is disposed in a position in which it is bilaterally symmetrical to the lower side roller conveyance section 23 in the up and down direction.

Support parts 50, which are plate-like metal plates having a substantially H shape as seen in a side view and extend along the substantially vertical direction, are attached to both the right and left ends of the lower side shaft 36L in such a way that the lower side shaft 36L fits into recessed portions 50L disposed recessed in the lower sides of the support parts 50.

The support parts 50 are likewise attached to both the right and left ends of the upper side shaft 36U in such a way that the upper side shaft 36U fits into recessed portions 50U disposed recessed in the upper sides of the support parts 50.

Because of this, the support parts 50 physically interconnect the lower side shaft 36L of the lower side roller conveyance section 23 and the upper side shaft 36U of the upper side roller conveyance section 22.

1-4. Operation and Effects

In the above configuration, in the lower side roller conveyance section 23, an upward reaction force FRU corresponding to the downward contact-pressure force FCD acts on the lower side shaft 36L via the springs 38.

For this reason, as indicated by the dashed line in FIG. 4, a force that causes the right and left direction center portion of the lower side guide top plate 46U to bend in the upward direction acts on the lower side guide top plate 46U using as supports the right and left end portions of the lower side guide top plate 46U that are connected to the frame 19.

Likewise, in the upper side roller conveyance section 22, a downward reaction force FRD corresponding to an upward contact-pressure force FCU acts on the upper side shaft 36U via the springs 64 (64R and 64L).

For this reason, as indicated by the dashed line in FIG. 4, a force that causes the right and left direction center portion of the upper side guide bottom plate 45L to bend in the downward direction acts on the upper side guide bottom plate 45L using as supports the right and left end portions of the upper side guide bottom plate 45L that are connected to the frame 19.

At this time, from the lower side roller conveyance section 23 the upward reaction force FRU acts on the support parts 50 via the lower side shaft 36L, and from the upper side roller conveyance section 22 the downward reaction force FRD acts on the support parts 50 via the upper side shaft 36U.

The upward reaction force FRU transmitted from the lower side roller conveyance section 23 urges the upper side shaft 36U in the upward direction and thus prevents the upper side shaft 36U from moving in the downward direction and prevents bending of the center section of the upper side guide bottom plate 45L in the downward direction.

Likewise, the downward reaction force FRD transmitted from the upper side roller conveyance section 22 urges the lower side shaft 36L in the downward direction and thus prevents the lower side shaft 36L from moving in the upward direction and prevents bending of the center section of the lower side guide top plate 46U in the upward direction.

In this way, because the reaction forces FRD and FRU act in mutually opposite directions on the lower side shaft 36L and the upper side shaft 36U that are located in the same positions in the front and rear and right and left directions, the roller conveyance section 20 may cancel out the forces that cause the lower side guide top plate 46U and the upper side guide bottom plate 45L to bend.

Because of this, the roller conveyance section 20 may prevent deformation of the upper side guide 45 and the lower side guide 46, prevent conveyance troubles (jams) in relation to the bank notes BL, and allow the bank notes BL to stably travel.

In the roller conveyance section 20, the upper side shaft 36U and the lower side shaft 36L are not fixed to the frame 19 but are fixed to the upper side guide bottom plate 45L and the lower side guide top plate 46U via the ribs 35U and 35L, so a reduction in the number of parts and space saving may be realized.

However, on the flip side, the roller conveyance section 20 has a configuration where the reaction forces FRD and FRU are received by the upper side guide bottom plate 45L and the lower side guide top plate 46U. For this reason, the upper side guide bottom plate 45L and the lower side guide top plate 46U tend to easily bend.

With respect to that, bending of the upper side guide bottom plate 45L and the lower side guide top plate 46U may be prevented by attaching reinforcement members including plate-like metal plates in such a way as to follow the lower side of the upper side guide bottom plate 45L and the upper side of the lower side guide top plate 46U.

However, in such case, the metal plate reinforcement members end up covering the upper side guide bottom plate 45L from the lower side and the lower side guide top plate 46U from the upper side. For this reason, it ends up becoming difficult for a worker to check the bank notes being conveyed on the bank note conveyance paths 48U and 48L.

With respect to that, the roller conveyance section 20 of the present exemplary embodiment may prevent bending of the lower side guide top plate 46U and the upper side guide bottom plate 45L without disposing metal plate members that reinforce the lower side guide top plate 46U and the upper side guide bottom plate 45L.

In this connection, it is also conceivable to prevent bending of the upper side guide 45 and the lower side guide 46 by adding separate parts to receive the reaction forces FRD and FRU so that the reaction forces FRD and FRU are not received by the upper side guide 45 and the lower side guide 46.

However, in such case, the number of parts ends up increasing despite the need for the roller conveyance section to be compact.

With respect to this, the roller conveyance section 20 of the present exemplary embodiment has a configuration where the reaction forces FRD and FRU are received by the upper side guide 45 and the lower side guide 46. For this reason, the roller conveyance section 20 of the present exemplary embodiment may prevent deformation of the upper side guide 45 and the lower side guide 46 with a simple configuration and without adding separate parts to receive the reaction forces FRD and FRU instead of the upper side guide 45 and the lower side guide 46.

Furthermore, in the roller conveyance section 20, there are cases where sensors that monitor whether or not the bank notes are being normally conveyed in the bank note conveyance paths 48U and 48L are attached to stays fixed to the upper side guide 45 or the lower side guide 46.

In such cases, by using the parts of the stays for attaching the sensors to attach the support parts 50 to the stays, the roller conveyance section 20 may be given an even simpler configuration.

Furthermore, it is also conceivable to prevent bending of the upper side guide 45 and the lower side guide 46 by changing the material of the upper side guide 45 and the lower side guide 46 to a hard material that does not easily become deformed.

However, in such case, restrictions end up being imposed on the materials that may be used for the upper side guide 45 and the lower side guide 46. With respect to this, the roller conveyance section 20 may use the upper side guide 45 and the lower side guide 46 that include the same material that has conventionally been used.

According to the above configuration, the roller conveyance section 20, which serves as a medium conveyance device in the bank note processing device 1, uses the support parts 50 to couple together the upper side shaft 36U, which receives the reaction force FRD produced in accordance with the contact-pressure force FCU that urges the driven rollers 56 toward the drive rollers 52, and the lower side shaft 36L, which receives the reaction force FRU produced in accordance with the contact-pressure force FCD that urges the driven rollers 30 toward the drive rollers 26.

Because of this, the bank note processing device 1 may cancel out the reaction forces FRD and FRU that are produced in accordance with the contact-pressure forces FCU and FCD that are applied to the driven rollers 56 and 30 in order to convey the bank notes BL in the bank note conveyance paths 48U and 48L that are adjacent to one another, and which reaction forces FRD and FRU cause the upper side guide 45 and the lower side guide 46 to bend.

2. Second Exemplary Embodiment

Figure 5:
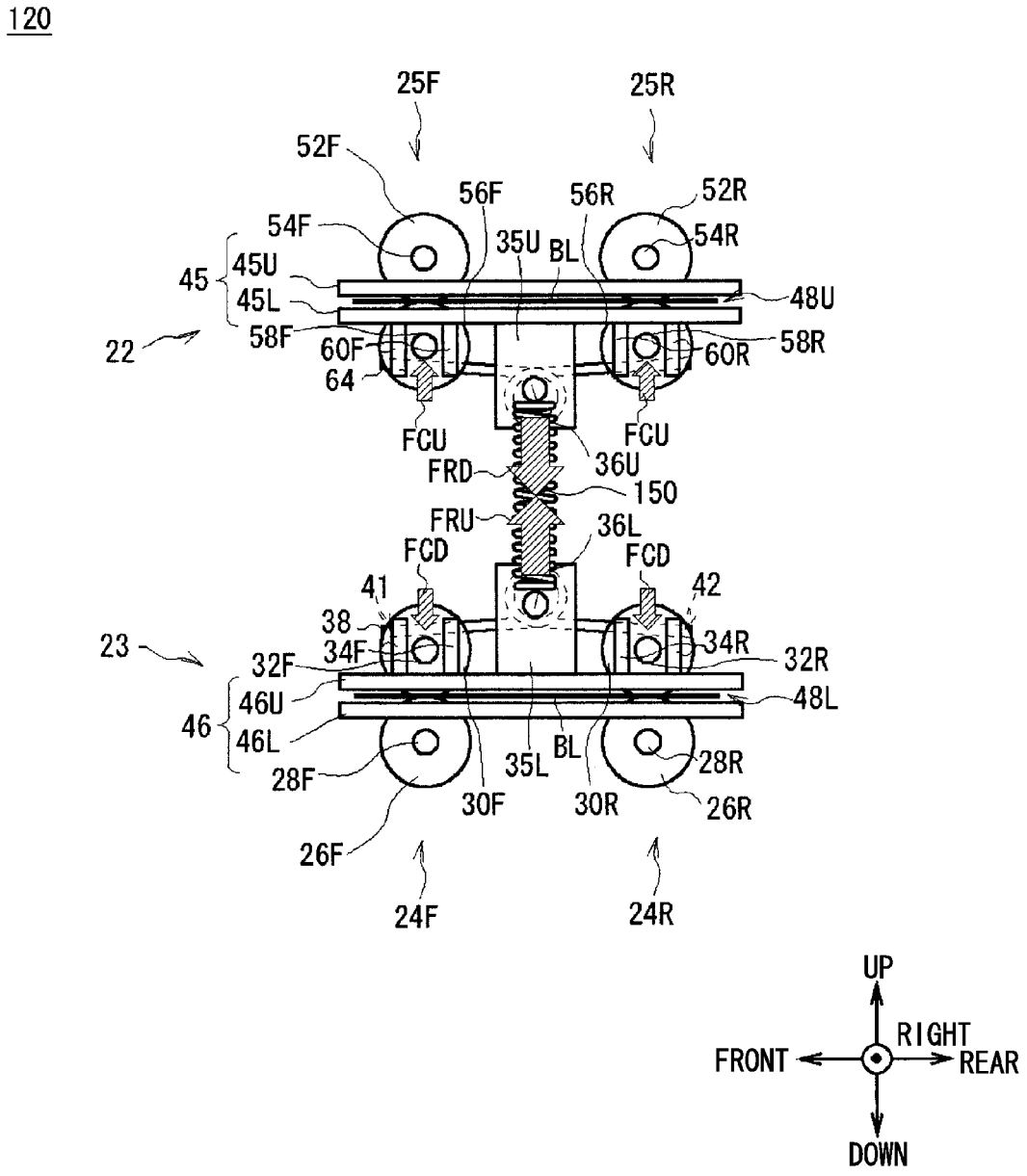
FIG. 5 is a right side view showing the configuration (1) of a roller conveyance section according to a second exemplary embodiment.
Figure 6:
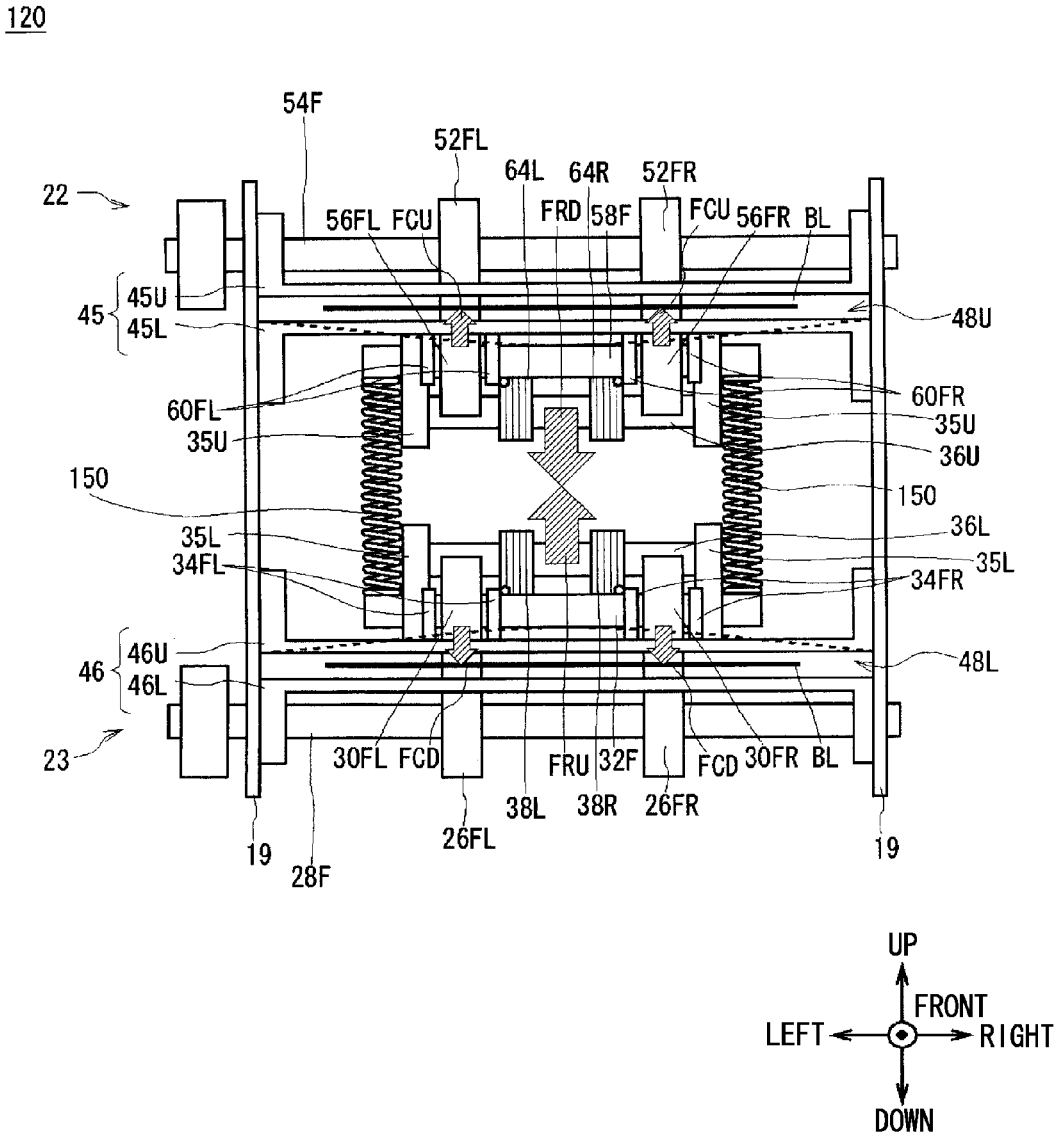
FIG. 6 is a front view showing the configuration (2) of the roller conveyance section according to the second exemplary embodiment.

A bank note processing device 1 according to a second exemplary embodiment is configured in the same way as the bank note processing device 1 according to the first exemplary embodiment except that, as shown in FIG. 5 and FIG. 6, in which the same reference signs are assigned to sections corresponding to those in FIG. 3 and FIG. 4, its roller conveyance section 120 differs from the roller conveyance section 20.

Furthermore, the roller conveyance section 120 according to the second exemplary embodiment has support parts 150 that differ from the support parts 50 according to the first exemplary embodiment.

The support parts 150 are configured by compression springs that are low-modulus bodies whose elastic modulus is lower than that of the support parts 50. The support parts 150 are fitted, in a support part compressed state in which they are shortened from their natural length, into both the right and left ends of the lower side shaft 36L of the lower side roller conveyance section 23 and the upper side shaft 36U of the upper side roller conveyance section 22.

For this reason, the support parts 150 urge, with the resilient force tending to return the support parts 150 to their natural state, the lower side shaft 36L in the downward direction and the upper side shaft 36U in the upward direction.

In the lower side roller conveyance section 23, the upward reaction force FRU corresponding to the downward contact-pressure force FCD acts on the lower side shaft 36L via the springs 38 and urges the support parts 150 upward in such a way as to shorten them even more than they are in the support part compressed state.

The support parts 150 shortened more than they are in the support part compressed state urge, with the resilient force tending to return the support parts 150 to their natural state, the upper side shaft 36U in the upward direction.

In the upper side roller conveyance section 22, the downward reaction force FRD corresponding to the upward contact-pressure force FCU acts on the upper side shaft 36U via the springs 64 and urges the support parts 150 downward in such a way as to shorten them more than they are in the support part compressed state.

The support parts 150 shortened more than they are in the support part compressed state urge, with the resilient force tending to return the support parts 150 to their natural state, the lower side shaft 36L in the downward direction.

In this support part compressed state, the reaction force FRU and the reaction force FRD counterbalance one another.

In the roller conveyance section 120, for example, when the bank notes BL do not travel on the bank note conveyance path 48U but travel only on the bank note conveyance path 48L, the driven roller shafts 32 move upward together with the driven rollers 30 against the downward contact-pressure force FCD by an amount corresponding to the thickness of the bank notes BL.

At this time, the springs 38 apply to the driven roller shafts 32 the contact-pressure force FCD that is stronger than it is in the spring compressed state because the front end portions of the front arm portions 41 and the rear end portions of the rear arm portions 42 are positioned further in the upward direction than they are in the spring compressed state. Because of this, the reaction force FRU acting on the shaft 36 in accordance with the contact-pressure force FCD also becomes stronger than it is in the spring compressed state.

The reaction force FRU acts on the support parts 150, but because the support parts 150 are compressed even more than they are in the support part compressed state, the reaction force FRU is absorbed and is virtually not transmitted to the upper side shaft 36U.

Because of this, the support parts 150 may prevent a situation where a more upward reaction force FRU than in the support part compressed state, in which the reaction force FRU and the reaction force FRD are balanced and cancel one another out, ends up being applied to the upper side shaft 36U.

In this connection, in the roller conveyance section 20 according to the first exemplary embodiment described above, for example, when the bank notes BL are conveyed only on the bank note conveyance path 48L, the driven roller shafts 32 move upward together with the driven rollers 30 against the downward contact-pressure force FCD by an amount corresponding to the thickness of the bank notes BL.

At this time, the springs 38 apply to the driven roller shafts 32 the contact-pressure force FCD that is stronger than it is in the spring compressed state because the front end portions of the front arm portions 41 and the rear end portions of the rear arm portions 42 are positioned further in the upward direction than they are in the spring compressed state. Because of this, the reaction force FRU corresponding to the contact-pressure force FCD also becomes stronger than it is in the spring compressed state.

The support parts 50 in the first exemplary embodiment described above have a high elastic modulus, so the amount of displacement caused by the reaction force FRU from the spring compressed state ends up being transmitted substantially as is to the upper side shaft 36U.

For this reason, in the roller conveyance section 20, the reaction force FRU transmitted from the lower side roller conveyance section 23 to the upper side roller conveyance section 22 becomes stronger than the reaction force FRD transmitted from the upper side roller conveyance section 22 to the lower side roller conveyance section 23.

Because of this, there is the potential for the right and left direction center section of the upper side guide bottom plate 45L to end up bending conversely in the upward direction more than in a normal state. At this time, if bank notes pass through the bank note conveyance path 48U in the upper side guide 45, there is the potential for conveyance troubles occurring.

In this way, in the roller conveyance section 20, when the bank notes BL travel on only either one of the bank note conveyance paths 48U and 48L, there is the potential for the reaction force FRD and the reaction force FRU to become unbalanced so that the upper side guide 45 or the lower side guide 46 ends up bending in such a way as to narrow the bank note conveyance path 48U or 48L.

With respect to this, in the roller conveyance section 120 according to the present exemplary embodiment, by configuring the support parts 150 with low-modulus bodies, when the bank notes BL are conveyed on only either one of the bank note conveyance paths 48U and 48L, the amount of displacement produced by the reaction force FRD or FRU from the spring compressed state may be absorbed (the imbalance in the reaction forces FRU and FRD can be absorbed) by the support parts 150, and bending of the upper side guide 45 and the lower side guide 46 may be stably prevented also when the bank notes are traveling.

3. Third Exemplary Embodiment

Figure 7:
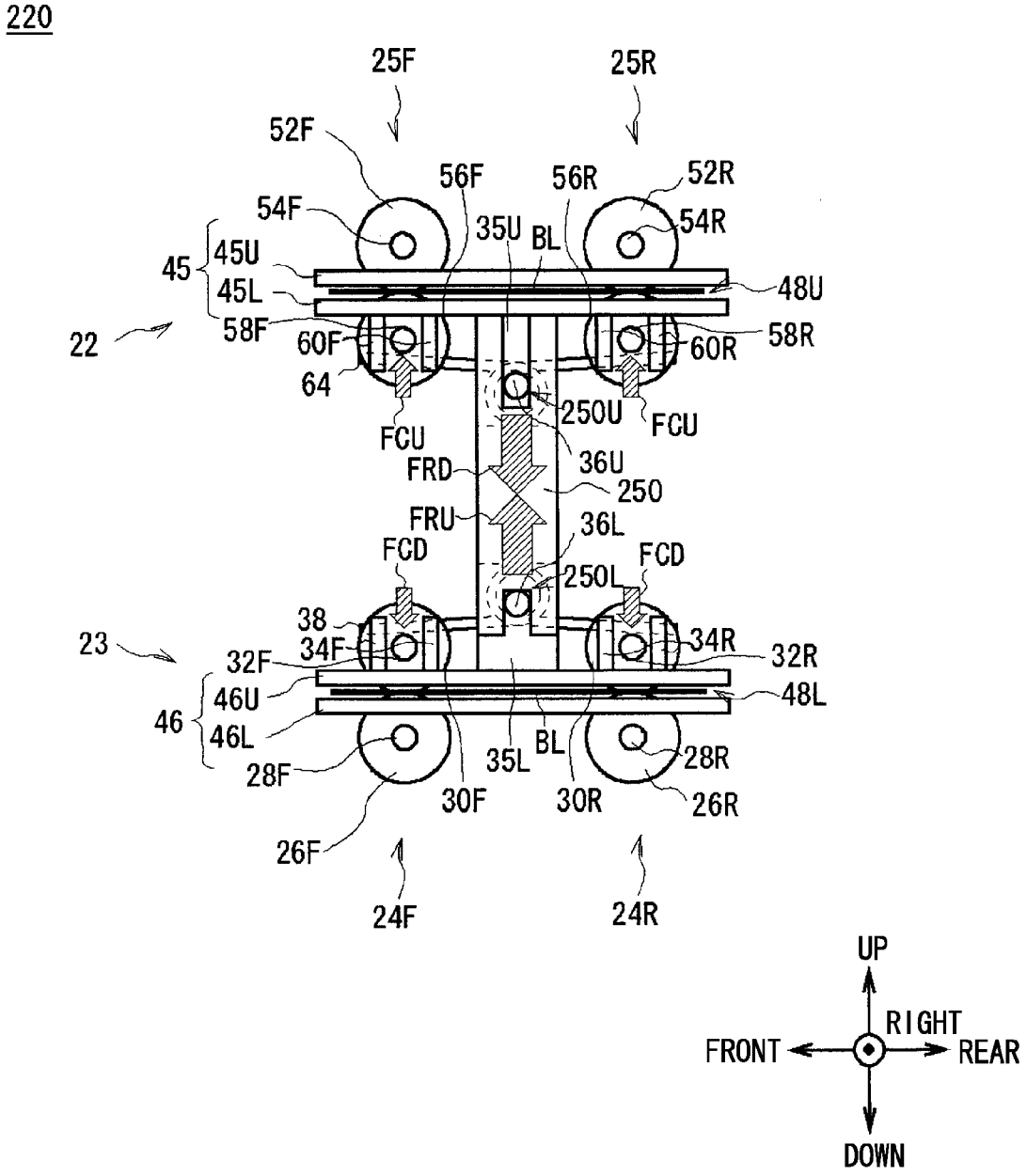
FIG. 7 is a right side view showing the configuration of a roller conveyance section according to a third exemplary embodiment.

A bank note processing device 1 according to a third exemplary embodiment is configured in the same way as the bank note processing device 1 according to the first exemplary embodiment except that, as shown in FIG. 7, in which the same reference signs are assigned to sections corresponding to those in FIG. 3, its roller conveyance section 220 differs from the roller conveyance section 20.

Furthermore, the roller conveyance section 220 according to the third exemplary embodiment has support parts 250 that differ from the support parts 50 according to the first exemplary embodiment.

The support parts 250 include plate-like metal plates having a substantially H shape as seen in a side view; the upper end portions of the support parts 250 are fixed to the upper side guide bottom plate 45L, the support parts 250 extend in the downward direction, and the lower side shaft 36L fits into recessed portions 250L disposed recessed in the lower sides of the support parts 250.

Furthermore, the upper side shaft 36U fits, in such a way as to be slidable in the upward and downward directions, into recessed portions 250U disposed recessed in the upper sides of the support parts 250.

According to this configuration, in the lower side roller conveyance section 23, the upward reaction force FRU corresponding to the downward contact-pressure force FCD acts on the support parts 250 from the lower side shaft 36L via the springs 38.

In the upper side roller conveyance section 22, the downward reaction force FRD corresponding to the upward contact-pressure force FCU acts on the upper side shaft 36U via the springs 64 and acts on the upper side guide bottom plate 45L via the ribs 35U to which the upper side shaft 36U is fixed. For this reason, the reaction force FRD is transmitted from the upper side guide bottom plate 45L to the support parts 250.

The upward reaction force FRU transmitted from the lower side roller conveyance section 23 via the support parts 250 urges the upper side guide bottom plate 45L in the upward direction and thus prevents bending of the right and left direction center section of the upper side guide bottom plate 45L in the downward direction.

Furthermore, the downward reaction force FRD transmitted from the upper side roller conveyance section 22 via the support parts 250 urges the lower side shaft 36L in the downward direction and thus prevents bending of the right and left direction center section of the lower side guide top plate 46U in the upward direction.

In this way, in the roller conveyance section 220, in contrast to the roller conveyance section 20, the reaction force FRD is transmitted from the support parts 250 via the lower side shaft 36L to the lower side guide top plate 46U, and the reaction force FRU is transmitted from the support parts 250 directly to the upper side guide bottom plate 45L.

Because of this, the roller conveyance section 220 may cancel out the forces that cause the upper side guide 45 and the lower side guide 46 to bend because the reaction forces FRD and FRU act in mutually opposite directions.

4. Fourth Exemplary Embodiment

Figure 8:
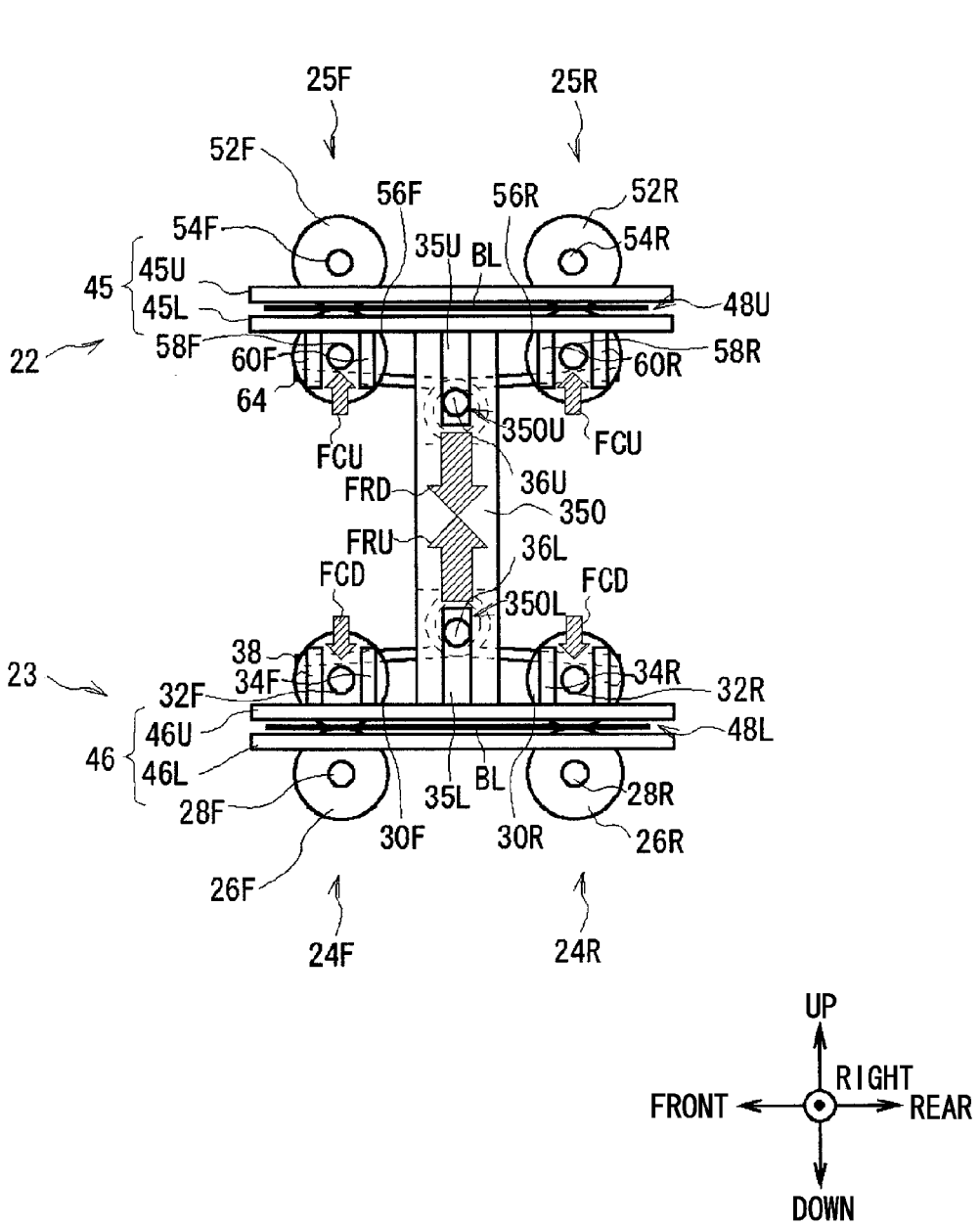
FIG. 8 is a right side view showing the configuration of a roller conveyance section according to a fourth exemplary embodiment.

A bank note processing device 1 according to a fourth exemplary embodiment is configured in the same way as the bank note processing device 1 according to the first exemplary embodiment except that, as shown in FIG. 8, in which the same reference signs are assigned to sections corresponding to those in FIG. 3, its roller conveyance section 320 differs from the roller conveyance section 20.

Furthermore, the roller conveyance section 320 according to the fourth exemplary embodiment has support parts 350 that differ from the support parts 50 according to the first exemplary embodiment.

The support parts 350 include plate-like metal plates having a substantially H shape as seen in a side view; the upper end portions of the support parts 350 are fixed to the upper side guide bottom plate 45L, and the lower end portions of the support parts 350 are fixed to the lower side guide top plate 46U, so that the support parts 350 physically interconnect the upper side guide bottom plate 45L and the lower side guide top plate 46U.

Furthermore, the upper side shaft 36U fits, in such a way as to be slidable in the upward and downward directions, into recessed portions 350U disposed recessed in the upper sides of the support parts 350, and the lower side shaft 36L fits, in such a way as to be slidable in upward and downward directions, into recessed portions 350L disposed recessed in the lower sides of the support parts 350.

According to this configuration, in the lower side roller conveyance section 23, the upward reaction force FRU corresponding to the downward contact-pressure force FCD acts on the lower side shaft 36L via the springs 38 and acts on the lower side guide top plate 46U via the ribs 35L to which the lower side shaft 36L is fixed. For this reason, the reaction force FRU is transmitted from the lower side guide top plate 46U to the support parts 350.

In the upper side roller conveyance section 22, the downward reaction force FRD corresponding to the upward contact-pressure force FCU acts on the upper side shaft 36U via the springs 64 and acts on the upper side guide bottom plate 45L via the ribs 35U to which the upper side shaft 36U is fixed. For this reason, the reaction force FRD is transmitted from the upper side guide bottom plate 45L to the support parts 350.

The upward reaction force FRU transmitted from the lower side roller conveyance section 23 via the support parts 350 urges the upper side guide bottom plate 45L in the upward direction and thus prevents bending of the right and left direction center section of the upper side guide bottom plate 45L in the downward direction.

The downward reaction force FRD transmitted from the upper side roller conveyance section 22 via the support parts 350 urges the lower side guide top plate 46U in the downward direction and thus prevents bending of the right and left direction center section of the lower side guide top plate 46U in the upward direction.

In this way, in the roller conveyance section 320, in contrast to the roller conveyance section 20, the reaction force FRU is transmitted from the support parts 350 directly to the upper side guide bottom plate 46L, and the reaction force FRD is transmitted from the support parts 350 directly to the lower side guide top plate 46U.

Because of this, the roller conveyance section 320 of the present exemplary embodiment may cancel out the forces that cause the upper side guide 45 and the lower side guide 46 to bend because the reaction forces FRD and FRU act in mutually opposite directions.

5. Fifth Exemplary Embodiment

Figure 9:
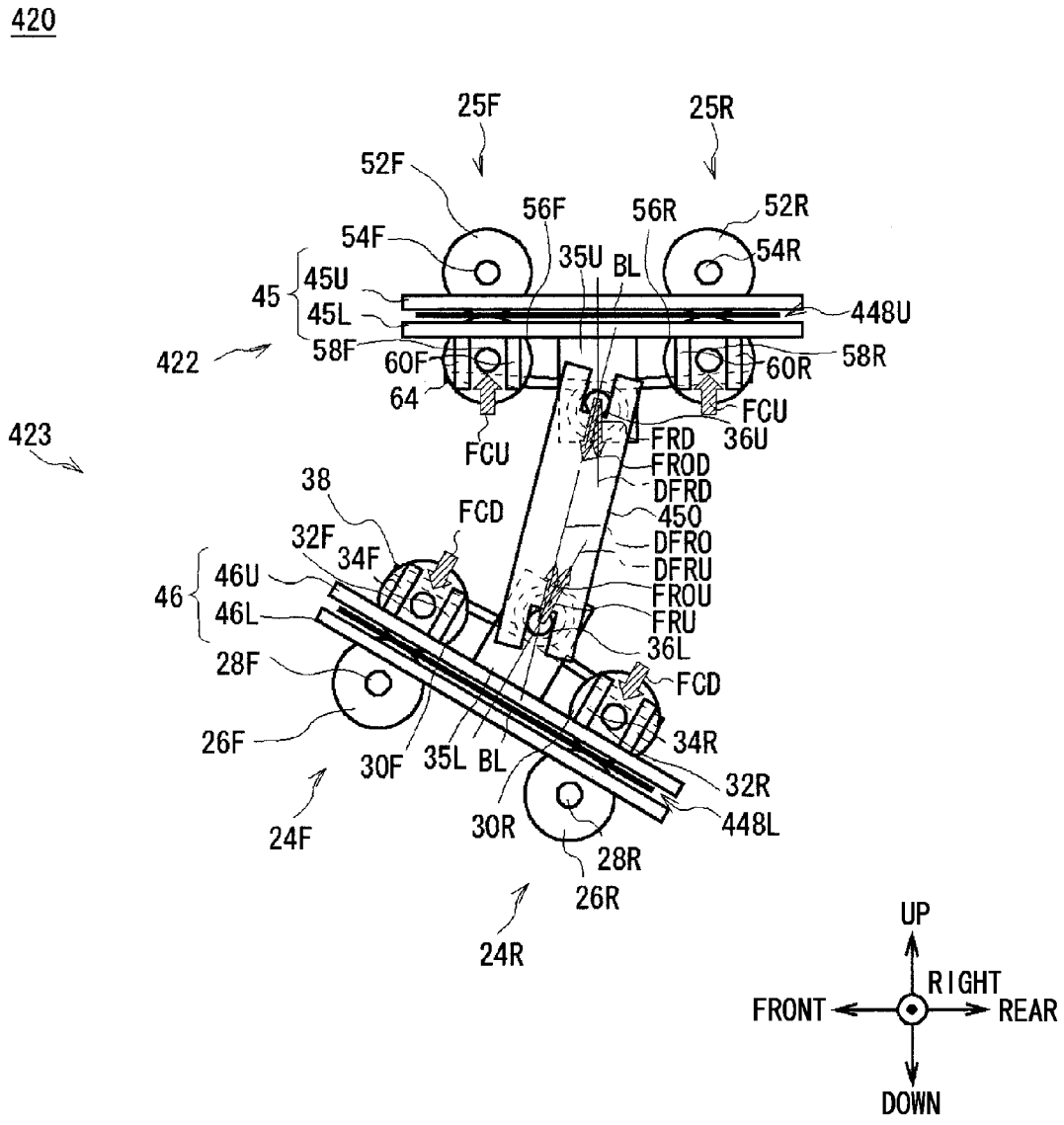
FIG. 9 is a right side view showing the configuration of a roller conveyance section according to a fifth exemplary embodiment.

A bank note processing device 1 according to a fifth exemplary embodiment is configured in the same way as the bank note processing device 1 according to the first exemplary embodiment except that, as shown in FIG. 9, in which the same reference signs are assigned to sections corresponding to those in FIG. 3, its roller conveyance section 420 differs from the roller conveyance section 20.

Furthermore, in the roller conveyance section 420 according to the fifth exemplary embodiment, a bank note conveyance path 448L is formed slanting relative to a bank note conveyance path 448U formed along the horizontal direction, and the roller conveyance section 420 has support parts 450 that differ from the support parts 50 according to the first exemplary embodiment.

The support parts 450, which include plate-like metal plates having a substantially H shape as seen in a side view, are attached slanting in the clockwise direction in FIG. 9 relative to the vertical direction to both the right and left ends of the lower side shaft 36L and the upper side shaft 36U.

Specifically, the support parts 450 are formed along an opposing reaction force direction DFRO, which is a direction between an upper side reaction force direction DFRD orthogonal to the bank note conveyance path 448U and a lower side reaction force direction DFRU orthogonal to the bank note conveyance path 448L and is parallel to the direction running through the upper side shaft 36U and the lower side shaft 36L. Furthermore, the support parts 450 are fixed to the upper side guide 45 by stays not shown in the drawing.

According to this configuration, in a lower side roller conveyance section 423, a rearward and upward reaction force FRU along the lower side reaction force direction DFRU corresponding to a frontward and downward contact-pressure force FCD acts on the lower side shaft 36L via the springs 38. Part of this reaction force FRU is transmitted from the lower side shaft 36L to the support parts 450 as an opposing reaction force FROU along the opposing reaction force direction DFRO.

In an upper side roller conveyance section 422, a downward reaction force FRD along the upper side reaction force direction DFRD corresponding to the upward contact-pressure force FCU acts on the upper side shaft 36U via the springs 64. Part of this reaction force FRD is transmitted from the upper side shaft 36U to the support parts 450 as an opposing reaction force FROD along the opposing reaction force direction DFRO.

Because of this, via the support parts 450 the opposing reaction force FROU is transmitted from the lower side roller conveyance section 423 to the upper side roller conveyance section 422 and the opposing reaction force FROD is transmitted from the upper side roller conveyance section 422 to the lower side roller conveyance section 423.

In this way, the roller conveyance section 420 may apply the opposing reaction forces FROD and FROU in mutually opposite directions via the support parts 450 even in a case where the bank note conveyance path 448U and the bank note conveyance path 448L are not formed parallel to one another, so the roller conveyance section 420 may cancel out the forces that cause the upper side guide 45 and the lower side guide 46 to bend.

6. Sixth Exemplary Embodiment

Figure 10:
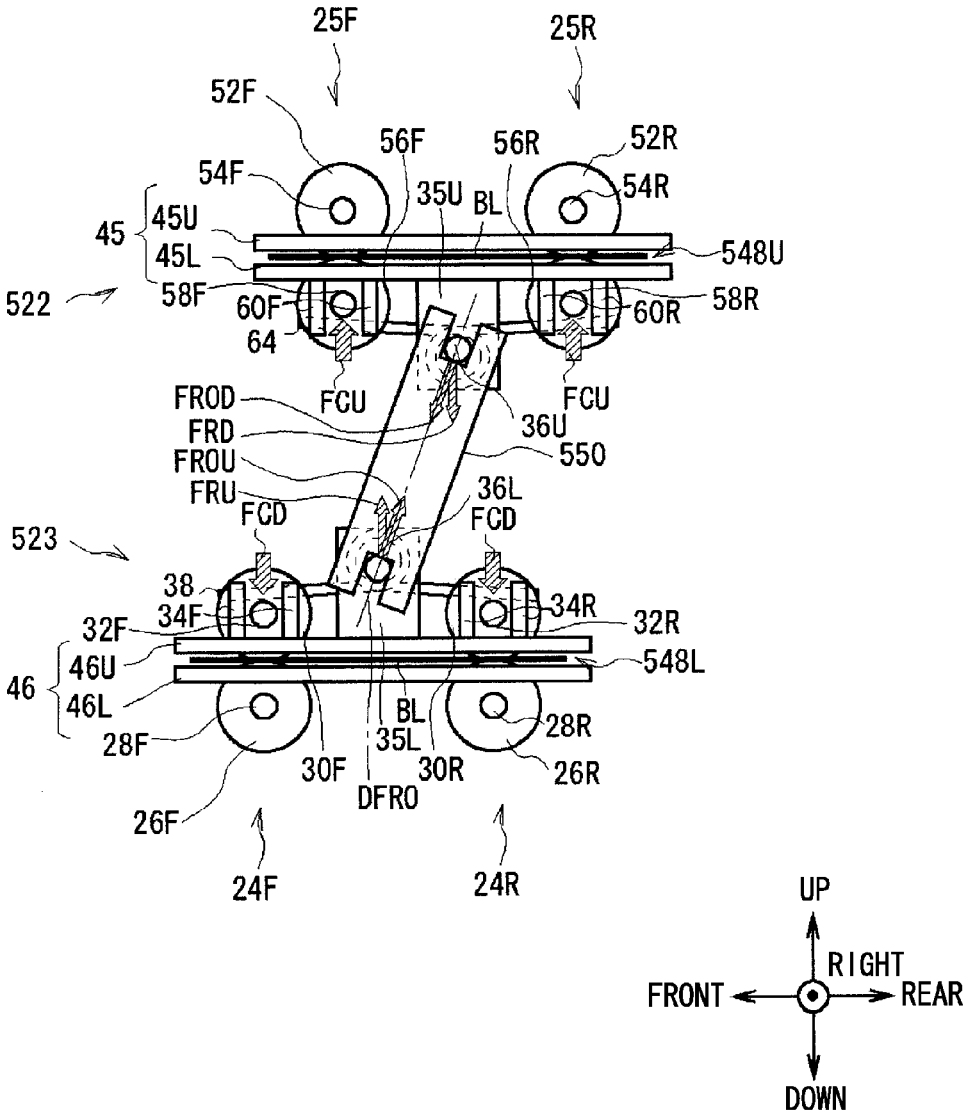
FIG. 10 is a right side view showing the configuration of a roller conveyance section according to a sixth exemplary embodiment.

A bank note processing device 1 according to a fifth exemplary embodiment is configured in the same way as the bank note processing device 1 according to the first exemplary embodiment except that, as shown in FIG. 10, in which the same reference signs are assigned to sections corresponding to those in FIG. 3, its roller conveyance section 520 differs from the roller conveyance section 20.

Furthermore, the roller conveyance section 520 according to the sixth exemplary embodiment has an upper side roller conveyance section 522 and a lower side roller conveyance section 523 that are disposed in such a way that their positions are out of alignment in the front and rear direction, and the roller conveyance section 520 has support parts 550 that differ from the support parts 50 according to the first exemplary embodiment.

The support parts 450, which include plate-like metal plates having a substantially H shape as seen in a side view, are attached slanting in the clockwise direction in FIG. 10 relative to the vertical direction to both the right and left ends of the lower side shaft 36L and the upper side shaft 36U.

Specifically, the support parts 450 are formed along an opposing reaction force direction DFRO, which is parallel to the direction running through the upper side shaft 36U and the lower side shaft 36L. Furthermore, the support parts 550 are fixed to the upper side guide 45 by stays not shown in the drawing.

According to this configuration, in the lower side roller conveyance section 523, the upward reaction force FRU corresponding to the downward contact-pressure force FCD acts on the lower side shaft 36L via the springs 38. Part of this reaction force FRU is transmitted from the lower side shaft 36L to the support parts 550 as an opposing reaction force FROU along the opposing reaction force direction DFRO.

In the upper side roller conveyance section 522, the downward reaction force FRD corresponding to the upward contact-pressure force FCU acts on the upper side shaft 36U via the springs 64. Part of this reaction force FRD is transmitted from the upper side shaft 36U to the support parts 550 as an opposing reaction force FROD along the opposing reaction force direction DFRO.

Because of this, via the support parts 550 the opposing reaction force FROU is transmitted from the lower side roller conveyance section 523 to the upper side roller conveyance section 522 and the opposing reaction force FROD is transmitted from the upper side roller conveyance section 522 to the lower side roller conveyance section 523.

In this way, the roller conveyance section 420 of the present exemplary embodiment may apply the opposing reaction forces FROD and FROU in mutually opposite directions via the support parts 550 even in a case where the upper side roller conveyance section 522 and the lower side roller conveyance section 523 are disposed in such a way that their positions are out of alignment in the front and rear direction. For this reason, the roller conveyance section 420 of the present exemplary embodiment may cancel out the forces that cause the upper side guide 45 and the lower side guide 46 to bend.

7. Other Exemplary Embodiments

It will be noted that, in the second exemplary embodiment, a case was described where compression springs are used as the support parts 150.

The present invention, not limited to this, and the support parts may also be configured by low-modulus bodies including rubber, for example. What matters is that the reaction force FRD is transmitted from the upper side roller conveyance section 22 to the lower side roller conveyance section 23, the reaction force FRU is transmitted from the lower side roller conveyance section 23 to the upper side roller conveyance section 22, and, in a case where either one of the reaction forces FRU or FRD of the upper side roller conveyance section 22 or the lower side roller conveyance section 23 becomes stronger, the support parts are able to absorb the amount of displacement. Furthermore, also in the third to sixth exemplary embodiments described above, the support parts may be configured by elastic bodies.

Furthermore, in the above described first exemplary embodiment, a case in which the bank note conveyance path 48U and the bank note conveyance path 48L are formed opposing one another in the up and down direction along the front and rear direction (horizontal direction), has been described.

The present invention is not limited to this, and the opposing conveyance paths may also be formed along the up and down direction (vertical direction) or an oblique direction (a direction slanted in the horizontal direction from the vertical direction). The same is also true regarding the second to fourth and sixth exemplary embodiments.

Moreover, in the above described first exemplary embodiment, a case in which the support parts 50 are fixed to both the right and left ends of the lower side shaft 36L and the upper side shaft 36U, has been described.

The present invention is not limited to this, and the support parts may be disposed in a variety of places, such as in the right and left direction center sections of the lower side shaft 36L and the upper side shaft 36U. What matters is that the support parts are able to transmit the reaction force FRU from the lower side shaft 36L to the upper side shaft 36U and transmit the reaction force FRD from the upper side shaft 36U to the lower side shaft 36L. The same is also true regarding the second to sixth exemplary embodiments.

Moreover, in above described the first exemplary embodiment, a case in which the roller conveyance section 20 is configured by two front and rear sets of conveyance sections: the lower side front conveyance section 24F of the lower side roller conveyance section 23 and the upper side front conveyance section 25F of the upper side roller conveyance section 22, and the lower side rear conveyance section 24R of the lower side roller conveyance section 23 and the upper side rear conveyance section 25R of the upper side roller conveyance section 22, has been described.

The present invention is not limited to this, and the roller conveyance section 20 may also be configured by only either one set of roller conveyance sections: the lower side front conveyance section 24F of the lower side roller conveyance section 23 and the upper side front conveyance section 25F of the upper side roller conveyance section 22, or the lower side rear conveyance section 24R of the lower side roller conveyance section 23 and the upper side rear conveyance section 25R of the upper side roller conveyance section 22. The same is also true regarding the second to sixth exemplary embodiments.

Moreover, in the described above sixth exemplary embodiment, a case in which the upper side roller conveyance section 522 and the lower side roller conveyance section 523 are disposed such that their positions are out of alignment in the front and rear direction, has been described. The present invention is not limited to this, and the upper side roller conveyance section and the lower side roller conveyance section may also be disposed in such a way that their positions are out of alignment in the right and left direction.

Moreover, in the above described fifth exemplary embodiment, rearward movement of the support parts 450 may also be regulated by using a predetermined member to stop the force in the rearward direction transmitted to the support parts 450 by the rearward and upward reaction force FRU.

Moreover, in the above described exemplary embodiments, cases in which the driven rollers are urged by springs that are torsion bar springs, have been descried. The present invention is not limited to this, and a variety of mechanisms, such as plate springs, for example, may be used to urge the driven rollers.

Moreover, in the above described exemplary embodiments, cases in which the present invention is applied when conveying bank notes in a roller conveyance section of a bank note processing device that processes cash, have been described.

The present invention is not limited to this and may also, for example, be applied when conveying a medium in an automated teller machine into which a medium such as cash is put and which performs desired transactions.

Moreover, in the above described exemplary embodiments, bank notes are described as the medium, but the present invention is not limited to this, and it suffices for the medium to be a thin paper medium such as gift certificates, cash vouchers, or admission tickets, for example.

Moreover, in the above described exemplary embodiments, cases in which the roller conveyance section 20 serving as a medium conveyance device is configured by the bank note conveyance path 48U serving as a first conveyance path, the drive rollers 52 serving as first drive rollers, the driven rollers 56 serving as first driven rollers, the springs 64 serving as first contact-pressure portions, the bank note conveyance path 48L serving as a second conveyance path, the drive rollers 26 serving as second drive rollers, the driven rollers 30 serving as second driven rollers, the springs 38 serving as second contact-pressure portions, and the support parts 50 serving as support portions, have been described.

The present invention is not limited to this, and the medium conveyance device may also be configured by a first conveyance path, first drive rollers, first driven rollers, first contact-pressure portions, a second conveyance path, second drive rollers, second driven rollers, second contact-pressure portions, and support portions including a variety of configurations.

The disclosure of Japanese Patent Application No. 2012-249637 is incorporated in its entirety by reference herein.

All publications, patent applications, and technical standards mentioned in this specification are incorporated by reference herein to the same extent as if each individual publication, patent application, or technical standard was specifically and individually indicated to be incorporated by reference.

INDUSTRIAL APPLICABILITY

The present invention may be utilized in a variety of devices that convey paper media such as bank notes.

The invention claimed is:

1. A medium conveyance device comprising:

a first conveyance path that conveys a medium;

first drive rollers that contact the medium and that cause the medium to move by rotation;

first driven rollers, disposed opposing the first drive rollers across the first conveyance path, that contact the medium and rotate in accordance with the rotation of the first drive rollers;

first contact-pressure portions that apply a first contact-pressure force that urges the first driven rollers toward the first drive rollers;

a second conveyance path that is adjacent to the first conveyance path and conveys a medium;

second drive rollers that contact the medium and that cause the medium to move by rotation;

second driven rollers, disposed opposing the first driven rollers and also opposing the second drive rollers across the second conveyance path, that contact the medium and rotate in accordance with the rotation of the second drive rollers;

second contact-pressure portions that apply a second contact-pressure force that urges the second driven rollers toward the second drive rollers; and support portions that couple a first reaction force receiving portion that receives a first reaction force produced toward the second conveyance path in accordance with the first contact-pressure force and a second reaction force receiving portion that receives a second reaction force produced toward the first conveyance path in accordance with the second contact-pressure force.

2. The medium conveyance device according to claim 1, wherein the support portions transmit to a second guide, forming the second conveyance path, the first reaction force that causes a first guide, forming the first conveyance path, to bend from the first guide toward the second guide, and transmit to the first guide the second reaction force that causes the second guide to bend from the second guide toward the first guide.

3. The medium conveyance device according to claim 2, wherein:

the first contact-pressure portions are first torsion bar springs whose coiled portions are coiled around a first shaft fixed to the first guide and whose arm portions urge the first driven rollers, and the support portions couple together the first shaft and the second guide.

4. The medium conveyance device according to claim 2, wherein:

the first contact-pressure portions are first torsion bar springs whose coiled portions are coiled around a first shaft fixed to the first guide and whose arm portions urge the first driven rollers, the second contact-pressure portions are second torsion bar springs whose coiled portions are coiled around a second shaft fixed to the second guide and whose arm portions urge the second driven rollers, and the support portions couple the first shaft and the second shaft.

5. The medium conveyance device according to claim 2, wherein the support portions couple the first guide and the second guide.

6. The medium conveyance device according to claim 1, wherein the support portions are configured by a material whose elastic force is lower than that of metal.

7. The medium conveyance device according to claim 6, wherein the support portions are compression springs disposed in a state in which they are compressed from a natural state.

* * * * *